US005138927A

United States Patent [19]

Nishimoto

[11] Patent Number: 5,138,927

[45] Date of Patent: Aug. 18, 1992

[54] FORMANT TONE GENERATING APPARATUS FOR AN ELECTRONIC MUSICAL INSTRUMENT EMPLOYING PLURAL FORMAT TONE GENERATION

[75] Inventor: Tetsuo Nishimoto, Hamamatsu, Japan

[73] Assignee: Yamaha Corporation, Hamamatsu, Japan

[21] Appl. No.: 500,401

[22] Filed: Mar. 27, 1990

[30] Foreign Application Priority Data

Mar. 29, 1989 [JP] Japan ..... 1-77383

[51] Int. Cl.[5] ..... G10H 1/06; G10H 7/00

[52] U.S. Cl. ..... 84/624; 84/659

[58] Field of Search ..... 84/622-625, 84/659-661, 692-700, 735, 736, DIG. 9

[56] References Cited

U.S. PATENT DOCUMENTS

Re. 32,862 2/1989 Wachi ..... 84/693
4,200,021 4/1980 Chibana ..... 84/623 X
4,351,219 9/1982 Bass ..... 84/622 X
4,422,362 12/1983 Chibana ..... 84/624
4,597,318 7/1986 Nikaido et al. ..... 84/625

FOREIGN PATENT DOCUMENTS 54-20851 7/1979 Japan .

*Primary Examiner*—Stanley J. Witkowski
*Attorney, Agent, or Firm*—Graham & James

[57] ABSTRACT

A formant tone generating apparatus provides n (where n=1, 2, . . . ) systems each capable of generating a pitch control signal by a timing of which period is n times longer than a fundamental pitch period of a musical tone including a formant tone to be generated. Then, a periodic function such as a sinewave function having a formant center frequency is modulated by use of a window function under control of the pitch control signal, so that a modulated signal is formed with respect to each system. Such modulated signals are synthesized together with respect to one or more systems, so that a synthesized signal is obtained. Based on the synthesized signal, the formant tone can be generated without forming unnecessary spectrum.

9 Claims, 22 Drawing Sheets

FIG. 1(a)
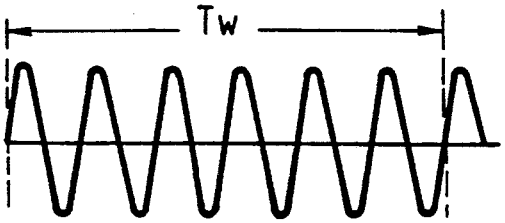
FIG. 1(b)
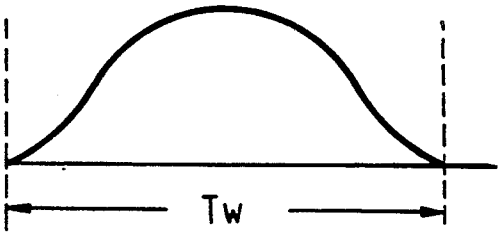
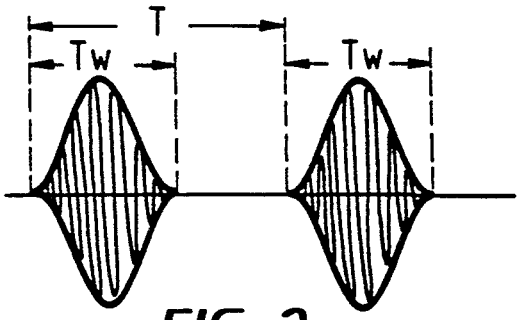
FIG. 2
FIG. 3(a)
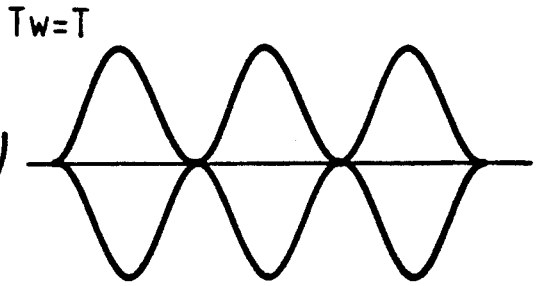
FIG. 3(b)
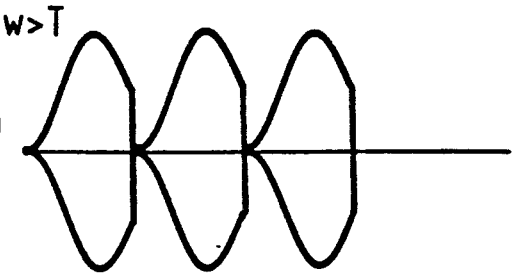

FIG. 6 (a)
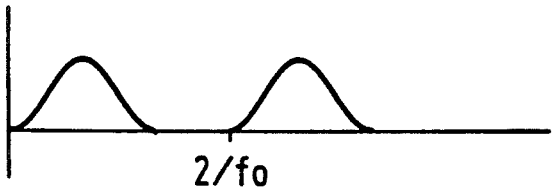
FIG. 6 (b)
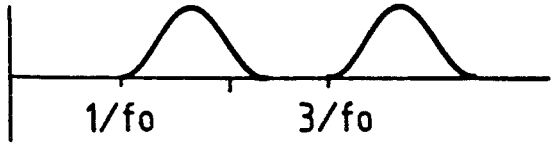
FIG. 7 (a)
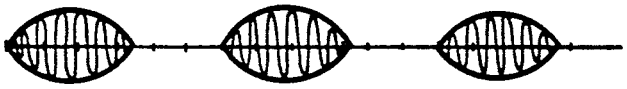
FIG. 7 (b)
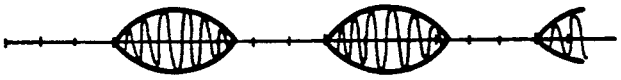
FIG. 7 (c)
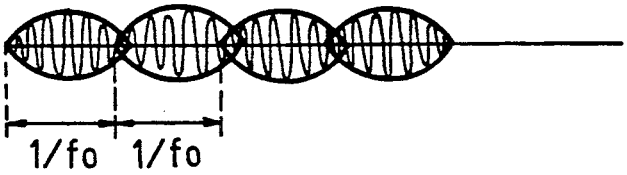
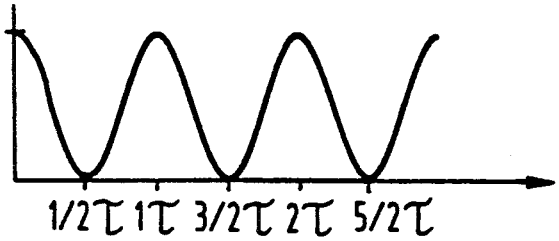
FIG. 8

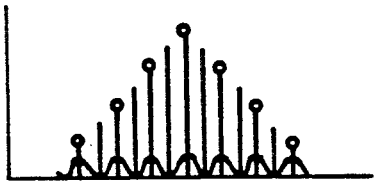
FIG. 9 (a)
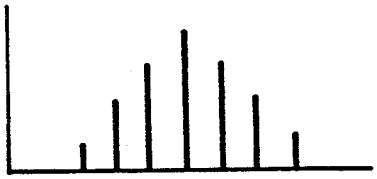
FIG. 9 (b)
FIG. 10 (a)
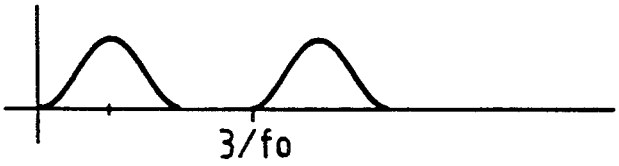
FIG. 10 (b)
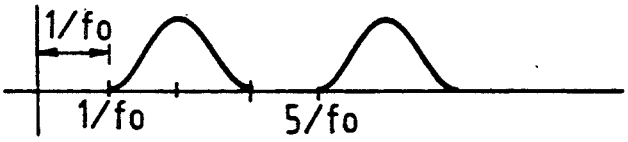
FIG. 10 (c)
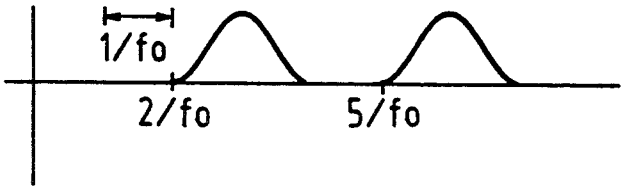
FIG. 11 (a)
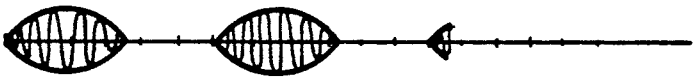
FIG. 11 (b)
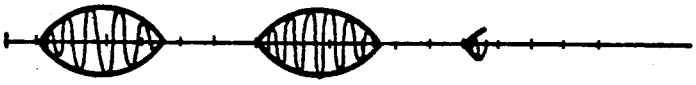
FIG. 11 (c)
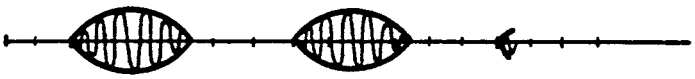
FIG. 11 (d)
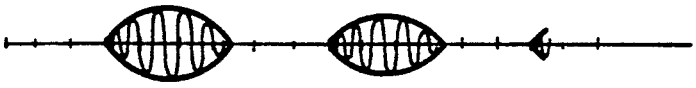
FIG. 11 (e)
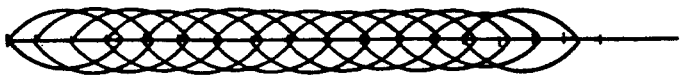

FORMANT TONE GENERATING APPARATUS FOR AN ELECTRONIC MUSICAL INSTRUMENT EMPLOYING PLURAL FORMAT TONE GENERATION

BACKGROUND OF THE INVENTION

1. Field of the Invention

The present invention relates to a formant tone generating apparatus which is suitable for generating wind instrument tones, human voices (chorus) and the like including formant tones.

2. Prior Art

U.S. Pat. No. 4,200,021 (based on Japanese Patent Publication No. 59-19352) discloses an electronic musical instrument which generates a musical tone including the formant such as wind instrument tone, human voice and the like. This electronic musical instrument multiplies a periodic waveform as shown in FIG. 1(*a*) by a window function as shown in FIG. 1(*b*) to thereby produce a waveform as shown in FIG. 2, which is used as a tone element of the musical tone to be generated. Then, such tone element is periodically generated. In this case, the period of generating the tone element corresponds to a tone pitch, i.e., a pitch period of the musical tone. In order to maintain the formant at constant level, it is necessary to always maintain phase of a periodic waveform at constant phase.

The above-mentioned conventional instrument can generate the musical tone in desirable manner only when a pitch period T is longer than a time width Tw of the window function as shown in FIG. 2 or when T equals to Tw as shown in FIG. 3(*a*). In contrast, when the pitch period T is shorter than Tw as shown in FIG. 3(*b*), the conventional instrument is disadvantageous in that unnecessary spectrum is produced. In case of FIG. 3(*b*) where Tw>T, next window function is started in the middle of certain window function, so that the unnecessary spectrum should be produced in a connection point between these two window functions. In other words, the conventional instrument cannot generate the high tone pitch because the pitch period T of which tone pitch can be generated is limited by the time width Tw of the window function.

In addition, the conventional instrument provides two waveform memories which store the periodic waveform and window function respectively. Then, data are read from these waveform memories in parallel, thereby forming the musical tone waveform. Therefore, the conventional instrument is disadvantageous in that its construction and control must be complicated.

Incidentally, as a method of producing two waveforms, "higher harmonic waveform generating method" is also known. However, even when such method is adopted, the construction must be complicated.

SUMMARY OF THE INVENTION

It is accordingly a primary object of the present invention to provide a formant tone generating apparatus capable of generating high tone pitch, regardless of the time width of the window function to be used.

It is another object of the present invention to provide a formant tone generating apparatus of which construction and control can be simplified by providing single waveform memory for storing necessary waveforms.

In a first aspect of the present invention, there is provided a formant tone generating apparatus comprising:

(a) window function generating means for generating a window function of which waveform is relatively smooth;

(b) periodic function generating mean for generating a periodic function having a formant center frequency;

(c) modulation means for modulating the periodic function by use of the window function; and (d) waveform synthesizing means for sequentially synthesizing waveforms formed and modulated by the modulation means, whereby a formant tone is generated based on a synthesized waveform formed by the waveform synthesizing means without forming unnecessary spectrum.

In a second aspect of the present invention, there is provided a formant tone generating apparatus comprising:

(a) pitch control means for controlling each of pitch control signals of n (where n denotes an integral number) systems to be generated by a timing of which period is n times longer than a fundamental pitch period of a musical tone to be generated, the pitch control means shifting timings of generating the pitch control signals by the fundamental pitch period;

(b) window function generating means for generating a window function having a smooth waveform with respect to each system every time each pitch control signal is generated;

(c) periodic function generating means for generating a periodic function having a formant center frequency with respect to each system, the periodic function generating means setting a phase of the periodic function at a predetermined phase every time the pitch control signal is generated;

d) modulation means for modulating the periodic function by use of the window function with respect to each system to thereby generate a modulated signal; and (e) addition means for sequentially adding the modulated signal generated from the modulation means with respect to each system, whereby a formant tone is generated based on an addition result of the addition means.

In a third aspect of the present invention, there is provided a formant tone generating apparatus comprising:

(a) pitch control signal generating means for generating each of pitch control signals of n systems (where n denotes an integral number) by a timing of which period is n times longer than a fundamental pitch period of a musical tone to be generated, the pitch control signals being controlled such that timings of generating the pitch control signals are shifted by the fundamental pitch period;

(b) a first accumulator for accumulating a first set value of each system every time each pitch control signal is generated;

(c) a second accumulator for accumulating a second set value of each system which is smaller than the first set value, an accumulation result of the second accumulator being reset to a predetermined value every time corresponding pitch control signal is generated;

(d) a periodic function storing table for storing values of a periodic function, the periodic function storing table being supplied with accumulation results of the first and second accumulators as its address data which is selected in time sharing manner with respect to each system;

(e) power means for raising data read from the periodic function storing table to the k (where k denotes an integral number) power based on the accumulation result of the second accumulator with respect to each system;

(f) multiplication means for multiplying the data read from the periodic function storing table based on the accumulation result of the first accumulator by data outputted from the power means with respect to each system; and (g) accumulation means for accumulating outputs of the multiplication means with respect to one or more systems at certain tone-generation timing.

BRIEF DESCRIPTION OF THE DRAWINGS

Further objects and advantages of the present invention will be apparent from the following description, reference being had to the accompanying drawings wherein a preferred embodiment of the present invention is clearly shown.

In the drawings:

FIGS 1(*a*) and 1(*b*) show waveforms of the periodic function and window function which are used to form the formant tone;

FIG. 2 shows a formant tone waveform;

FIGS. 3(*a*) and 3(*b*) show formant tone waveforms with respect to the window function time width;

FIGS. 6 to 12 show waveforms for explaining operations of an embodiment; and

DESCRIPTION OF A PREFERRED EMBODIMENT

Next, description will be given with respect to a preferred embodiment of the present invention.

A. CONFIGURATION OF EMBODIMENT

Figure 4:
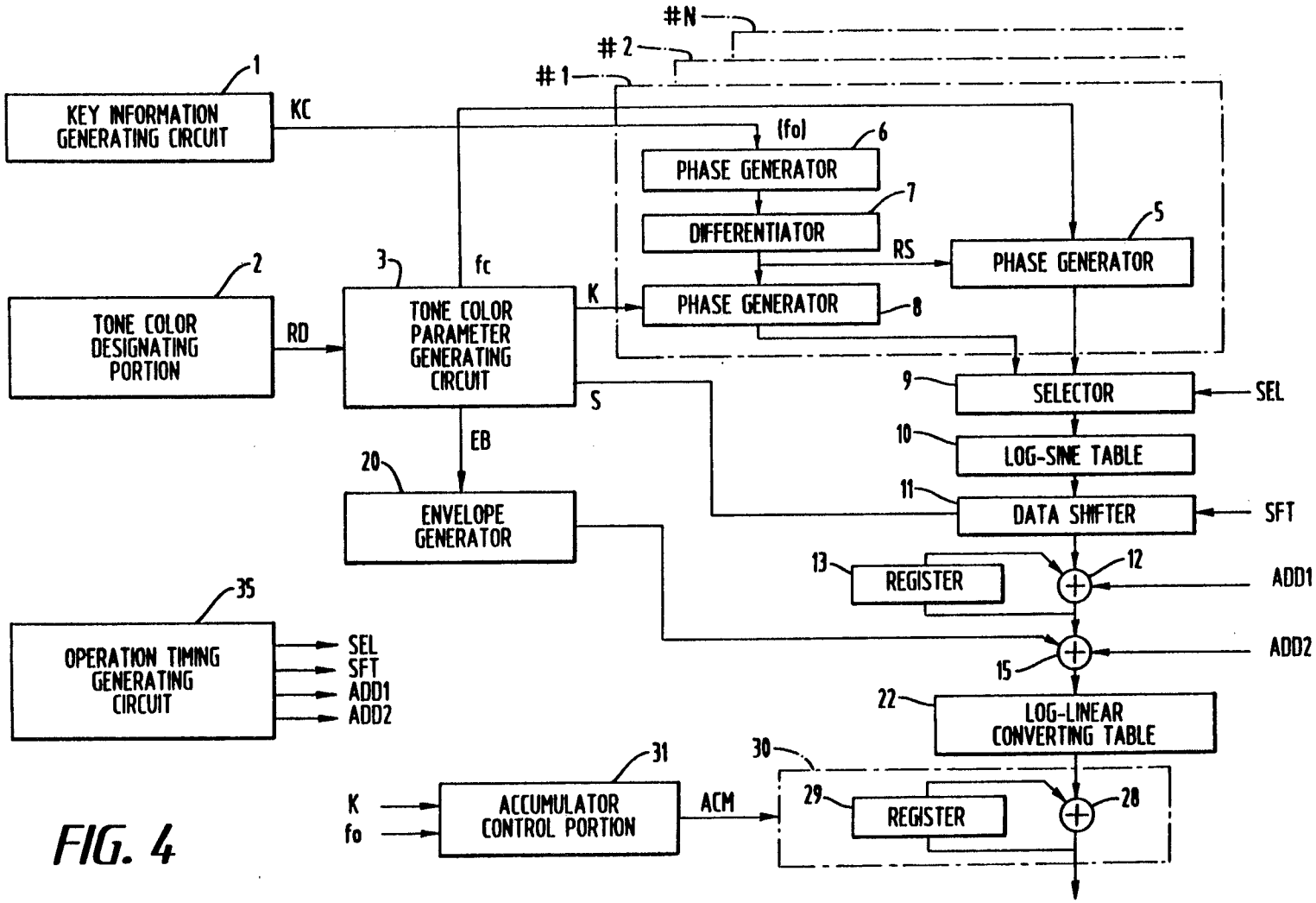
FIG. 4 is a block diagram showing an electronic musical instrument to which a formant tone generating apparatus according to an embodiment of the present invention is applied.

FIG. 4 is a block diagram showing the electric configuration of an electronic musical instrument to which the formant tone generating apparatus according to an embodiment of the present invention is applied. In FIG. 4, the present electronic musical instrument includes a key information generating circuit 1, a tone color designating portion 2 and a tone color parameter generating circuit 3. Herein, the key information generating circuit 1 is constructed by a keyboard and its peripheral circuits (not shown). This key information generating circuit 1 generates a key code KC indicative of a depressed key in the keyboard and a key-on signal KON indicative of a key-on event. The tone color designating portion 2 includes plural switches and controls, each generating tone color designating data RD. The tone color parameter generating circuit 3 generates several kinds of tone color parameters fc, K, S, N, EB (which will be described later) corresponding to the tone color designating data RD. These tone color parameters are supplied to several circuit portions of FIG. 4.

Figure 5:
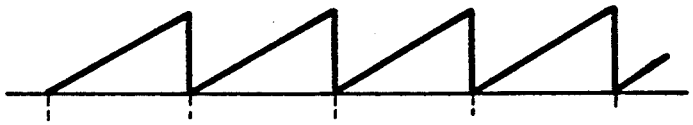
FIGS. 5(*a*)–(*e*) show waveforms at several circuit portions in FIG. 4.
Figure 5:
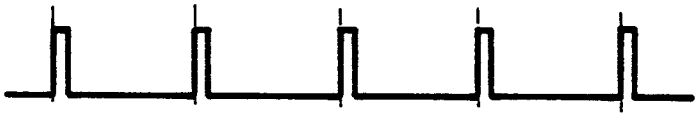
Figure 5:
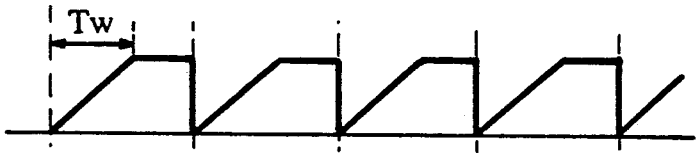
Figure 5:
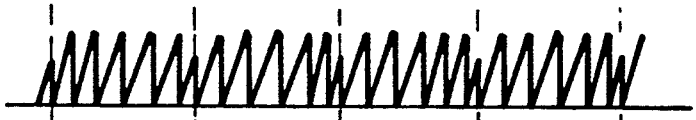
Figure 5:
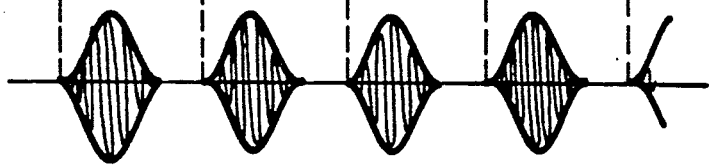

Next, a phase generator 5 accumulates values of formant center frequencies fc which are one kind of the tone color parameters. As the formant center frequency fc is low, the accumulation speed of the phase generator 5 is set low. In contrast, as the formant center frequency fc is high, the accumulation speed is set high. When the accumulation result overflows the predetermined limit, it is returned to the predetermined initial value. In such manner, the accumulation is repeatedly carried out. Therefore, while the formant center frequency fc is relatively high, the repeating period of the accumulation is set relatively short. In contrast, while the formant center frequency fc is relatively low, the repeating period of the accumulation is set relatively long. FIG. 5(*d*) shows variation manner in the accumulation result of the phase generator 5. As shown in FIG. 5(*d*), every time the accumulation result overflows the limit, it is reset to its initial value. The accumulation output of the phase generator 5 is supplied to a log-sine (i.e., logarithm-sinewave) table 10 as its address data via a selector 9.

Another phase generator 6 is constructed by an accumulator, which inputs the key code KC from the key information generating circuit 1 as fundamental pitch frequency data fo. Then, the phase generator 6 sequentially accumulates the inputted pitch frequency data fo. As similar to the foregoing phase generator 5, the phase generator 6 resets its accumulation result to zero when overflowing the limit value, by which the accumulation is repeatedly carried out (see FIG. 2(*a*)). Therefore, the accumulation period of the phase generator 6 corresponds to the fundamental pitch frequency data fo. As fundamental pitch frequency data fo becomes larger, the accumulation period becomes shorter. The phase generator 6 outputs an overflow pulse (e.g., most significant bit (MSB) of its output data) to a differentiator 7 which is constructed by a one-shot multivibrator. At the leading edge timing of the overflow pulse, the differentiator 7 generates and outputs a reset pulse RS as shown in FIG. 5(*b*) to the phase generators 5, 8. In other words, at a timing when it is detected that the output of the phase generator 6 is at "0" level, the differentiator 7 outputs the reset pulse RS. This reset pulse RS forces the phase generator 5 to be reset as shown in FIG. 5(*d*).

The phase generator 8 receives a phase constant K of tone element modulated wave supplied from the tone color parameter generating circuit 3 as the tone color parameter. Then, the phase generator 8 accumulates such phase constant K in synchronism with the predetermined clock. When the accumulation result overflows the limit value, this phase generator 8 maintains its last value (i.e., the limit value). Next, when the reset pulse RS is supplied to the phase generator 8, the phase generator 8 resets its accumulation contents to thereby re-start its accumulation again. As shown in FIG. 5(*c*) which indicates the accumulation result of the phase generator 8, the accumulation result gradually increases from "0" level after the timing of the reset pulse RS, and then the phase generator 8 stops increasing and therefore maintaining its accumulation result after the accumulation result overflows the limit value. Such accumulation result of the phase generator 8 is also supplied to the log-sine table 10 as address data via the selector 9. In this case, the phase constant K is set such that the accumulation speed of the phase generator 8 is quite slower than that of the foregoing phase generator 5. The selector 9 selects the output data of the phase generator 5 when a selecting signal SEL is supplied thereto, while the selector 9 selects the output data of the phase generator 8 when SEL is not supplied thereto.

Next, the log-sine table 10 stores log-sine data of one period, which selectively outputs desirable data corresponding to the address data from the selector 9. Therefore, the log-sine table 10 outputs a function value by a time interval corresponding to the accumulation result of the phase generator 5 or 8.

A data shifter 11 shifts the output data of the log-sine table 10 in accordance with shift value data S which is one of the tone color parameters. This shift operation is activated only when a shift signal SFT is supplied to the data shifter 11. Therefore, the data shifter 11 merely transmits the output data of the log-sine table 10 as it is when the shift signal SFT is not supplied thereto. In the present embodiment, the shift operation of the data shifter 11 is carried out in upper-bit-direction (i.e., left-most-bit-direction) by bits corresponding to the shift value data S. Based on such shift operation, the output data of the log-sine table 10 is increased by a factor of $2^S$. Herein, the output data of the log-sine table 10 is the logarithmic value, therefore, the antilogarithm is obtained by raising the logarithmic value to $2^S$. Thus, the output data of the log-sine table 10 which is read out based on the accumulation result of the phase generator 8 is shifted to the value as indicated in the following formula (1) by the data shifter 11.

$$\sin^a Kt \qquad (1)$$

where $a=2^S$ and t indicates the accumulation times.

Next, an adder 12 adds outputs of the data shifter 11 and a register 13 together when an addition signal ADD1 is supplied thereto. When the addition signal ADD1 is not supplied to the adder 12, the adder 12 merely transmits the output data of the data shifter 11. The register 13 temporarily stores the input data of the adder 12. Herein, the adder 12 performs the addition operation by use of the logarithmic data. Hence, the antilogarithm is obtained by multiplying the addition result by certain value.

Then, the output data of the adder 12 is supplied to another adder 15 which is activated by another addition signal ADD2. When the addition signal ADD2 is supplied to the adder 15, the adder 15 adds the output data of the adder 12 to an output of an envelope generator 20. The envelope generator 20 generates the predetermined envelope data (having the logarithmic value when the key-on signal KON is supplied thereto. Herein, the envelope data is determined by envelope designating data EB which is one kind of the tone color parameters. Of course, the adder 15 performs the addition operation on the logarithmic values, which means that the multiplication is carried out on the antilogarithms. A log-linear (i.e., logarithm-linear) converting table 22 converts the logarithmic data outputted from the adder 15 into the antilogarithm. The output data of this log-linear converting table 22 is accumulated by an accumulator 30 consisting of an adder 28 and a register 29. The accumulation operation of this accumulator 30 is controlled by an accumulation timing signal ACM outputted from an accumulator control portion 31. This accumulator control portion 31 produces the accumulation timing signal ACM based on the fundamental pitch frequency data fo and phase constant K of tone element modulated wave. In addition, an operation timing generating circuit 35 generates operation timing signals such as ADD1, ADD2, SEL, SFT.

Meanwhile, the present embodiment provides plural systems #1 to #N (where N denotes an arbitrary integral number) each including the phase generators 5, 6, 8 and differentiator 7. In response to the operation mode to be selected, different system is activated.

B. OPERATION OF EMBODIMENT

Next, description will be given with respect to the operation of the present embodiment.

In the present embodiment, $(2\times n)$ time slots are set, wherein the operation is carried out by each time slot based on time sharing manner. Herein, n is set as follows by use of the window function time width Tw and its frequency $fw=1/Tw$.

$$fo \leqq fw: \quad n=1$$
$$fw \leqq fo \leqq 2fw: \quad n=2$$
$$2fw \leqq fo \leqq 3fw: \quad n=3$$
$$3fw \leqq fo \leqq 4fw: \quad n=4$$

In the above-mentioned manner, the value n is set based on the relation between the window function time width Tw and fundamental pitch frequency data fo. As described before, the fundamental pitch frequency data fo corresponds to the key code KC.

Next, description will be given with respect to the operation of the present invention in cases of n=1, 2, 3, 4 respectively.

(1) First Case where n=1 (i.e., $fo \leqq fw$)

Since n=1, the number of the time slots is "2", wherein respective time slots are denoted as TS1, TS2. In this case, only the system #1 is activated.

At first, the performer operates the tone color designating portion 2 to thereby set the desirable tone color. In response to this operation, the corresponding tone color designating data RD is outputted, which activates the tone color parameter generating circuit 3 to output the tone color parameters such as the formant center frequency data fc, phase constant K of tone element modulated wave etc. When receiving the formant center frequency data fc, the phase generator 5 starts to carry out the accumulation operation as shown in FIG. 5(*d*). When receiving the phase constant K, the phase generator 8 starts to carry out the accumulation operation as shown in FIG. 5(*c*).

Next, when the performer performs the keyboard (not shown), the key information generating circuit 1 generates the key-on signal KON and key code KC corresponding to the depressed key. This key code KC is supplied to the phase generator 6 as the fundamental pitch frequency data fo. As a result, the phase generator 6 carries out the accumulation operation as shown in FIG. 5(*a*). The period between reset timing and overflow timing in the accumulation of the phase generator 6 corresponds to the fundamental pitch frequency data fo, therefore, the reset pulse RS outputted from the differentiator 7 corresponds to the fundamental pitch frequency data fo as well. Such reset pulse RS is supplied to both of the phase generators 5, 8. For this reason, the accumulation start timing of the phase generator 5 coincides with that of the phase generator 8.

Meanwhile, generation of the key-on signal KON activates the time slot TS1.

In the time slot TS1, the operation timing generating circuit 35 outputs the selecting signal SEL. Thus, the accumulation result of the phase generator 5 is supplied to the log-sine table 10 via the selector 9 as the address data. As a result, the log-sine data corresponding to such address data is read from the log-sine table 10. The read log-sine data is supplied to and then stored in the register 13 via the data shifter 11 and adder 12.

In next time slot TS2, the operation timing generating circuit 35 stops generating the selecting signal SEL but starts to generate other operation signals SFT, ADD1, ADD2. As a result, the accumulation result of the phase generator 8 is supplied to the log-sine table 10 via the selector 9 as the address data. Thus, the corresponding log-sine data is read from the log-sine table 10. This log-sine data is shifted in the upper-bit-direction by the predetermined bits in the data shifter 11. If the shift value data S outputted from the tone color parameter generating circuit 3 is at "1", the shift value of the data shifter 11 is "one bit", which means that the log-sine data is doubled in the data shifter 11. In other words, double in logarithmic value means that the antilogarithm is raised to the second power. In short, the operation of "$\sin^2 Kt$" (where t denotes the accumulation times) is carried out in the data shifter 11. Then, the output data of the data shifter 11 is supplied to the adder 12 to which the addition signal ADD1 is supplied. Therefore, the adder 12 adds the output data of the data shifter 11 and data stored in the register 13 together. The addition result of the adder 12 is added to the logarithmic envelope data outputted from the envelope generator 20 in the adder 15. The addition operation in the adder 15 is carried out on the logarithmic values, which means that the multiplication operation is carried out on the antilogarithms. Thereafter, the addition result (i.e., logarithmic data) of the adder 15 is converted into the antilogarithm data by the log-linear converting table 22. The antilogarithm data is outputted via the accumulator 30. In the present case where n=1, the accumulator 30 does not carry out the accumulation operation.

Thereafter, the above-mentioned operations in the time slots TS1, TS2 are repeated. As described above, one addition result is outputted from the adder 12 by every two time slots TS1, TS2, and then such addition result is converted into the antilogarithm data to be sequentially outputted from the present system. Herein, the data generated in the time slot TS1 has a periodic waveform as indicated by sin(fc*t), whereas the data generated in TS2 corresponds to the window function as indicated by the foregoing formula (1). The logarithmic values of the above-mentioned periodic waveform and window function are added together in the adder 12, which means the multiplication operation is substantially carried out on the antilogarithm values. FIG. 5(*e*) shows a multiplied wave which is obtained by multiplying the sinewave corresponding to the formant center frequency fc by the window function (i.e., wave of $\sin^2$) of which period corresponds to the foregoing time width Tw. Such multiplied wave is outputted by every period of 1/fo. In short, the present electronic musical instrument can generate the formant tone having the pitch frequency fo. For convenience' sake, FIG. 5(*e*) shows the waveform which is not subject to the envelope processing.

(2) Second Case where n=2 (i.e., fw≦fo≦2fw)

The performer's operation in the second case where n=2 is similar to that in the foregoing first case where n=1. However, the number of time slots is increased to four such as TS1, TS2, TS3, TS4, and the systems #1, #2 are both activated. FIGS. 6(*a*), 6(*b*) show waveforms of window functions which are produced in the systems #1, #2 respectively. As shown in FIGS. 6(*a*), 6(*b*), both periods of generating the window functions in the systems #1, #2 are set at 2/fo. However, timing of generating the window function of the system #2 is delayed from timing of generating the window function of the system #1 by 1/fo. Such delay (1/fo) is caused because there is a timing deviation of 1/fo between the operation start timings of the phase generators 6 in the systems #1, #2.

Next, description will be given with respect to processings of formant waveforms generated in the systems #1, #2. As similar to the foregoing first case where n=1, the multiplication operation is carried out on the periodic sinewave and window function (i.e., wave of $\sin^2$) based on the accumulated value (i.e., address data of the log-sine table 10) in the system #1 in the time slots TS1, TS2. Then, the multiplication result is stored in the register 29 within the accumulator 30. In next time slots TS3, TS4, the multiplication operation as similar to that in the foregoing first case is also carried out on the periodic wave and window function based on the address data of the log-sine table 10 in the system #2. In the adder 28, the multiplication result of #2 is added to the foregoing multiplication result of #1 stored in the register 29. Then, the addition result of adder 28 is outputted as the data representative of the formant tone waveform based on the accumulation results of the systems #1, #2. In the meantime, the accumulator 30 does not carry out the accumulation operation during the period where the window function of either #1 or #2 is only produced as shown in FIG. 6.

FIGS. 7(*a*), 7(*b*) show respective formant waveforms based on the systems #1, #2, and FIG. 7(*c*) shows formant waveform which is the addition result of two formant waveforms as shown in FIGS. 7(*a*), 7(*b*). When two formant waveforms are added together as shown in FIG. 7(*c*), the spectrum is maintained as it is but the period (1/fo) becomes shorter than the window function time width Tw. The reason why the spectrum is not varied will be described below by use of some formulae.

First, description will be given with respect to Fourier transform corresponding to the addition of two time-deviated waveforms.

Herein, X(f) denotes Fourier-transformed function (hereinafter, simply referred to Fourier function) which is obtained from time function x(t). Therefore, the following Fourier function F[x(t+τ)] can be obtained from time function x(t+τ).

$$\begin{aligned} F[x(t+\tau)] &= \int x(t+\tau)\, e^{-j2\pi ft} \\ &= e^{j2\pi ft} \int x(\tau)\, e^{-j2\pi ft} \\ &= e^{j2\pi ft}\, X(f) \end{aligned} \tag{2}$$

As shown in the above formula (2), phase of x(t+τ) is led from that of X(t) by 2πft.

Therefore, with respect to the Fourier function X(f) of the waveform shown in FIG. 7(*a*), Fourier function of the waveform shown in FIG. 7(*b*) is $e^{j2\pi ft}X(f)$. Such two waveforms are synthesized together as indicated in the following formula (3).

$$X(\omega)+e^{j\omega\tau}X(\omega)=(1+e^{j\omega\tau})X(\omega) \tag{3}$$

Herein, the spectrum can be indicated by the following formula (4) which is obtained by raising the absolute value of right side of the formula (3) to the second power.

$$|(1 + e^{j\omega\tau})X(\omega)|^2 = |(1 + e^{j\omega\tau})|^2 * |X(\omega)|^2 \quad (4)$$
$$e^{j\omega\tau} = \cos\omega\tau + j\sin\omega\tau \quad (5)$$

Based on the formula (5), the formula (4) can be rewritten as the following formula (6).

$$|(1+e^{j\omega\tau})| = [(1+\cos\omega\tau)^2+\sin^2\omega\tau]^{\frac{1}{2}} \quad (6)$$

Right side of the formula (6) can be further rewritten as the following formula (7).

$$(1 + 2\cos\omega\tau + \cos^2\omega\tau + \sin^2\omega\tau)^{\frac{1}{2}} = [2(1 + \cos\omega\tau)]^{\frac{1}{2}} \quad (7)$$

The absolute value of the right side in the formula (3) is raised to the second power as indicated in the following formula (8).

$$2(1+\cos\omega\tau)|X(\omega)|^2 \quad (8)$$

Herein, "$|X(\omega)|^2$" indicates the spectrum of the waveform as shown in FIG. 7(*a*) or 7(*b*) which is not subject to the waveform synthesis. In addition, "$(1+\cos\omega\tau)$" is the function having the periodic waveform as shown in FIG. 8, wherein its value is returned to "0" by every timing of $f=1/2\ \tau, 2/2\ \tau, \ldots$ (where $\omega=2\pi f$). Therefore, the spectrum of the synthesized waveform as shown in FIG. 7(*c*) can be obtained by removing waveform portions of $f=1/2\tau, 3/2\tau, \ldots$ from the spectrum waveforms as shown in FIGS. 7(*a*), 7(*b*). For example, the spectrum waveform prior to the waveform synthesis is as shown in FIG. 9(*a*), whereas the spectrum waveform which is subject to the waveform synthesis is as shown in FIG. 9(*b*) where the waveform portions of $f=1/2\tau, 3/2\tau, \ldots$ are removed. Therefore, the spectrum waveform which is subject to the waveform synthesis lacks several waveform components. However, as a whole, the spectrum waveform is not substantially changed by the waveform synthesis. For this reason, it is possible to raise the period pitch larger than the window function time width Tw without substantially varying the formant waveform.

(3) Third Case where n=3 (i.e., $2fw \leqq fo \leqq 3fw$)

In this case where n=3, six time slots, i.e., TS1 to TS6 are set, and three systems #1 to #3 are activated. FIGS. 10(*a*), 10(*b*), 10(*c*) respectively show the waveforms of the window functions generated in the systems #1, #2, #3. As shown in FIG. 10, the periods of generating the window functions based on the accumulation results of the systems #1 to #3 are all equal to 3/fo. However, the window function generating timing of the system #2 is delayed behind that of the system #1 by 1/fo, and the window function generating timing of the system #3 is delayed behind that of the system #2 by 1/fo. Such delay is occurred because of the 1/fo shift in the operation start timings of the phase generators 6 in the systems #1, #2, #3.

In the third case, the formant waveforms generated from the systems #1 to #3 are processed as similar to the foregoing second case where n=2.

(4) Fourth Case where n=4 (i.e., $3fw \leqq fo \leqq 4fw$)

In this case, the systems #1 to #4 are all activated, wherein the processings are made as similar to the foregoing third case where n=3. The window function generating period of each of the systems #1 to #4 is set at 4/fo, and the window function generating timings of the systems #1, #2, #3, #4 are shifted by 1/fo in turn.

FIGS. 11(*a*) to 11(*d*) respectively show the formant waveforms based on the accumulation results of the systems #1 to #4. Then, such four formant waveforms are synthesized together in the accumulator 30, from which the synthesized formant waveform as shown in FIG. 11(*e*) is to be generated. This synthesized formant waveform has the period pitch of 1/fo which is one-fourth or more shorter than the window function time width Tw. In this case, the spectrum waveform (i.e., envelope waveform of the spectrum) is not substantially changed as described before, therefore, the same formant tone can be sounded with high pitch.

As described heretofore, it is also possible to generated the formant tone even in case of n equals to "5" or more. In such case, the systems #1 to #n are activated, wherein the window function generating period of each system is set at n/fo.

C. MODIFIED EXAMPLES

The present embodiment can be modified into the following examples.

(1) The present embodiment uses sinewave function raised in a factor of $2^S$ as the window function, however, it is possible to use other functions. Herein, it is necessary for the window function to have the smooth waveform of which differentiated value does not intermit. When another function is used as the window function, such function is stored in the table, from which the desirable function value is to be read. Further, it is possible to use certain function table in addition to the foregoing log-sine table, wherein each of these tables are selectively used in response to the tone color. Meanwhile, the present embodiment uses sinewave as the periodic waveform, however, it is possible to use other periodic waveforms in the present invention.

Figure 12:
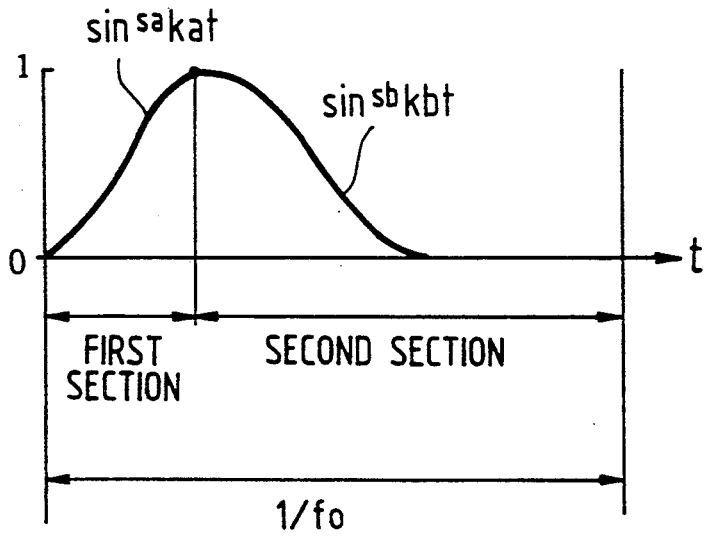
Figure 13:
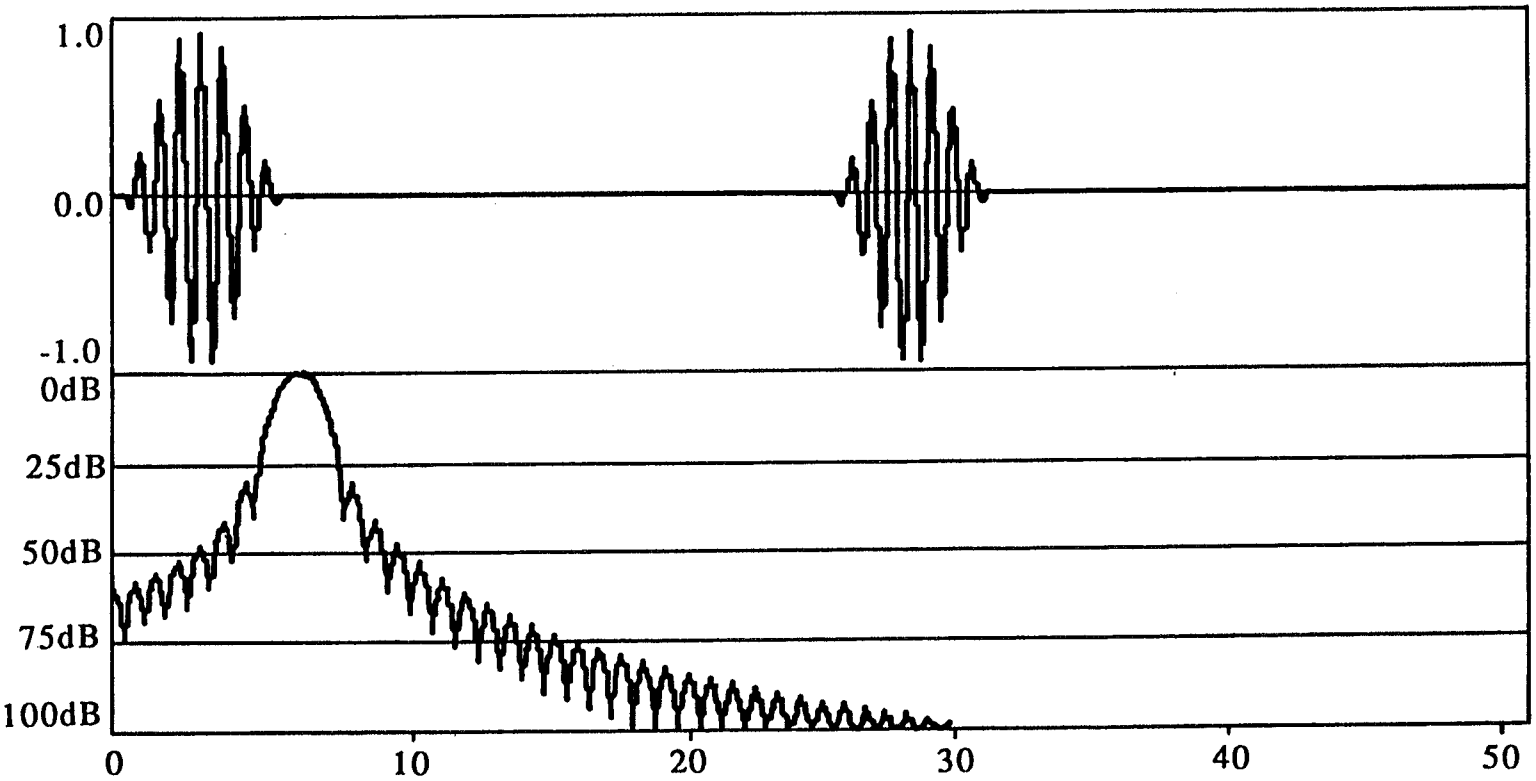
FIGS. 13 to 28 show experiment results of an embodiment.
Figure 14:
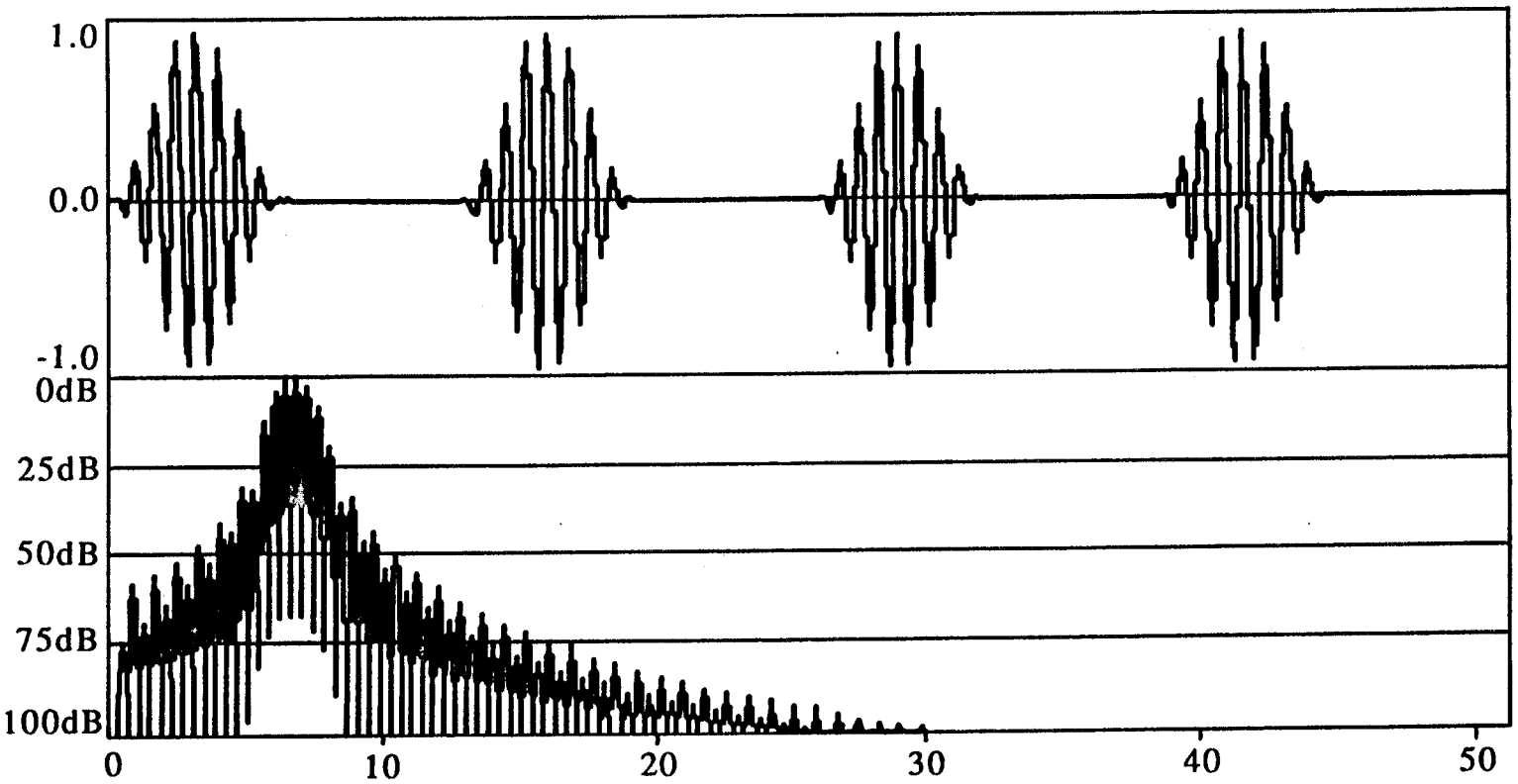
Figure 15:
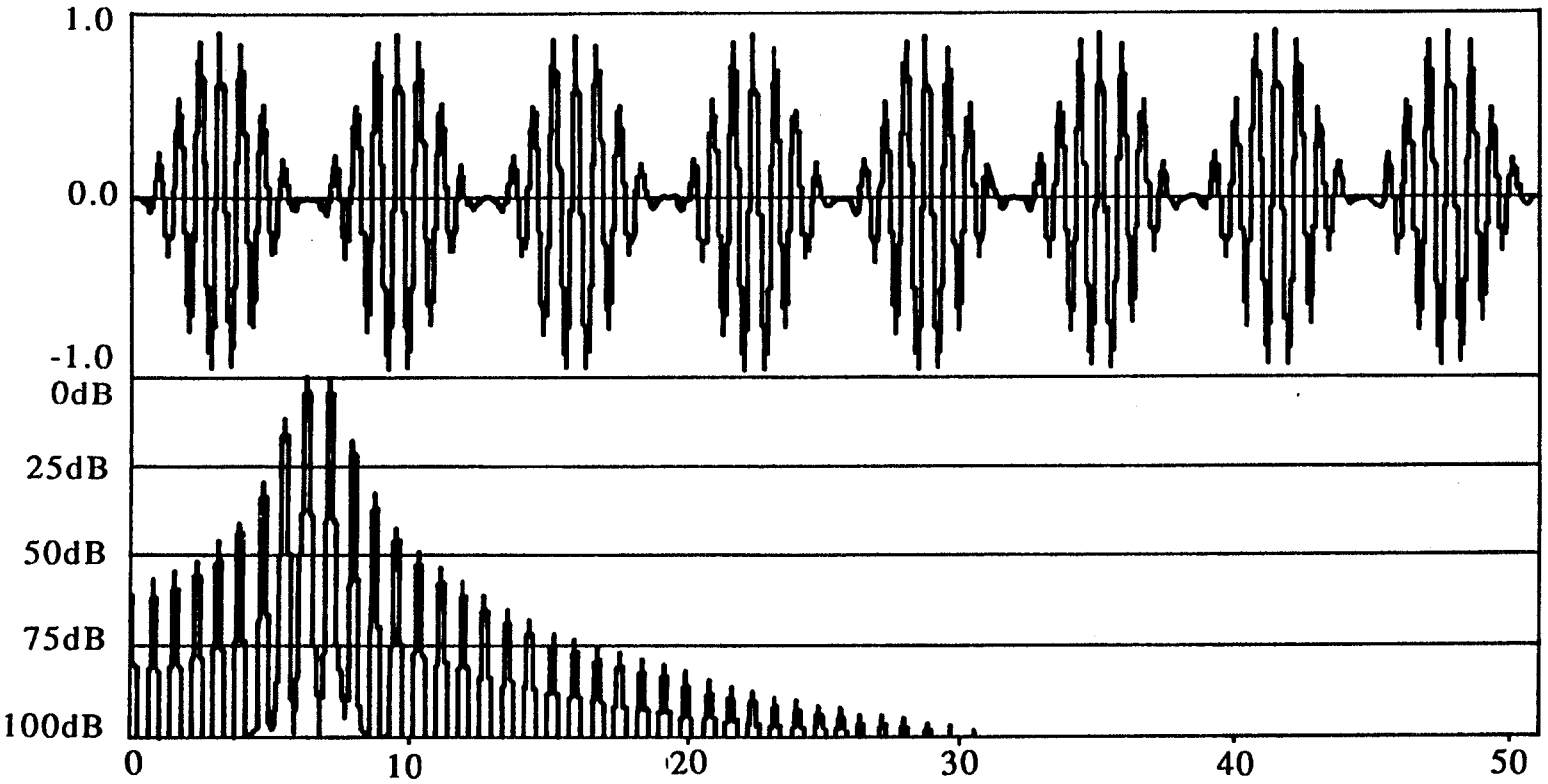
Figure 16:
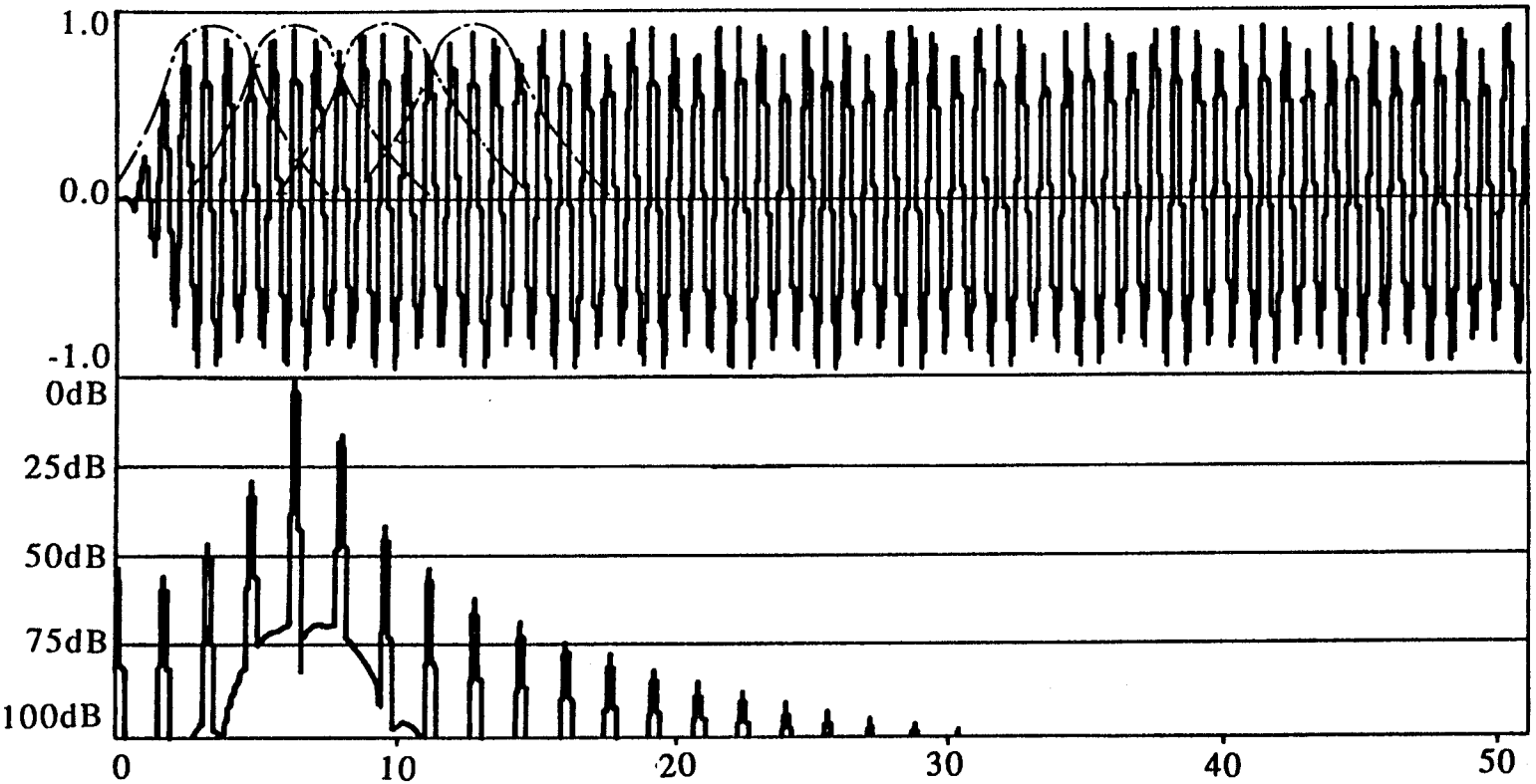
Figure 17:
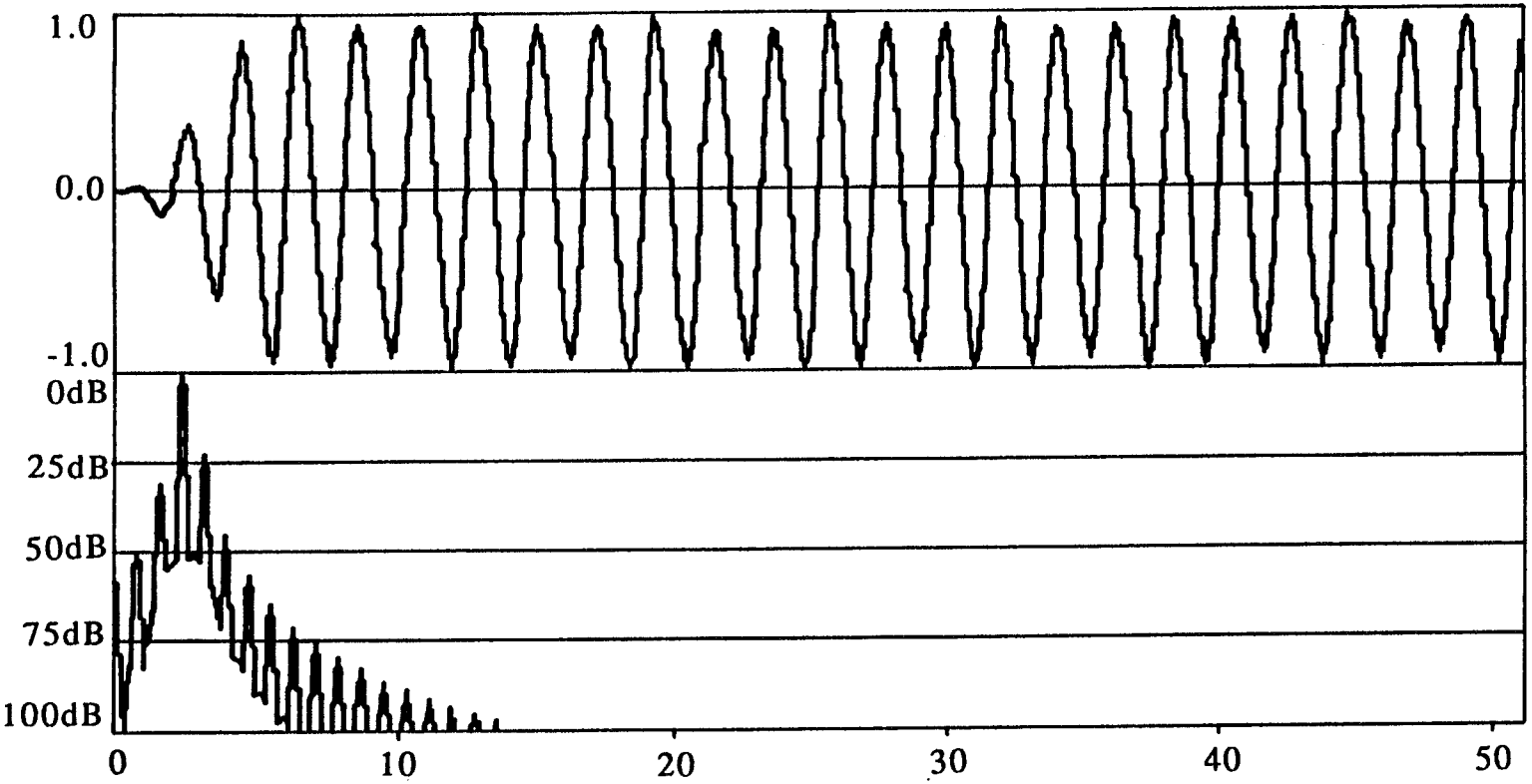
Figure 18:
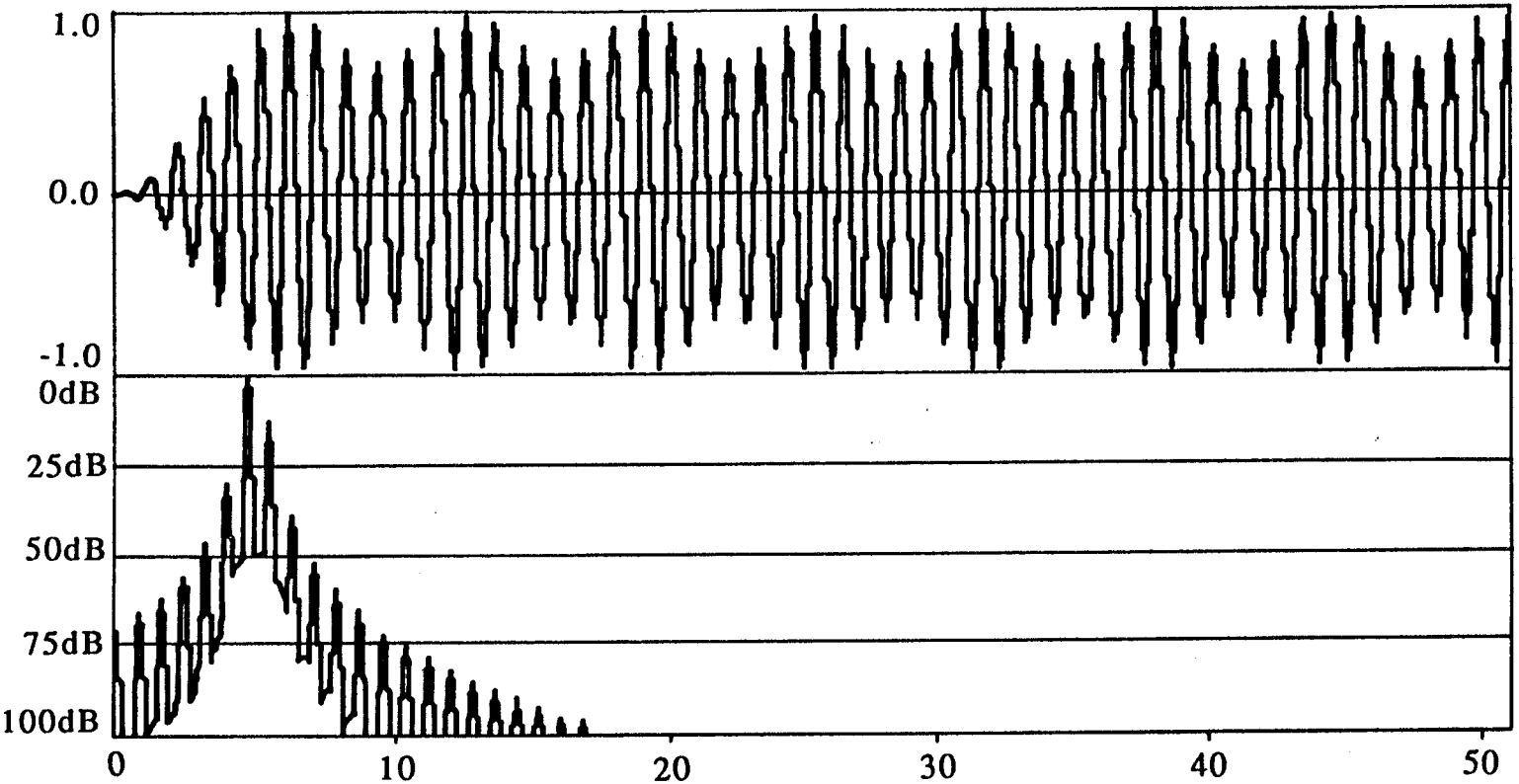
Figure 19:
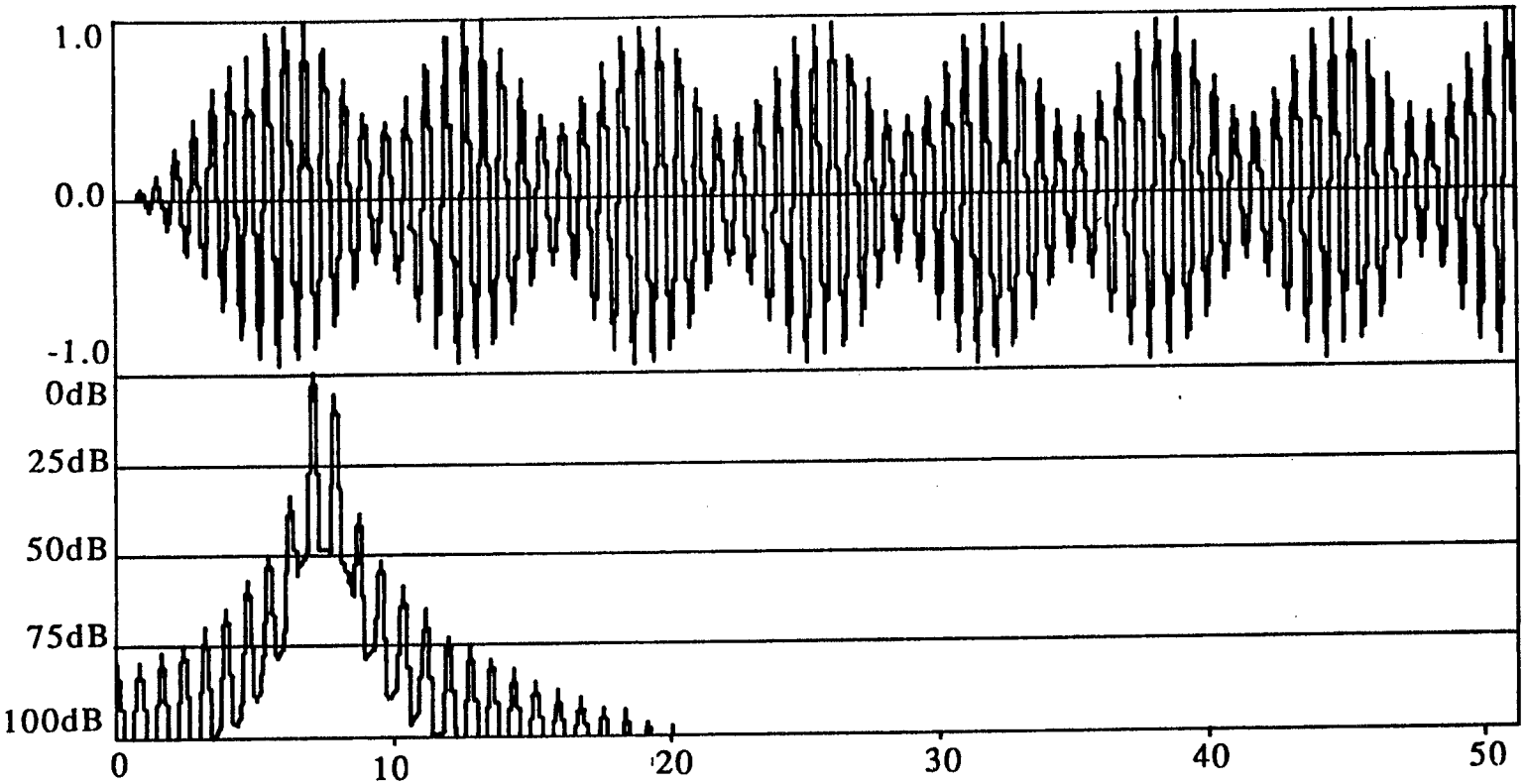
Figure 20:
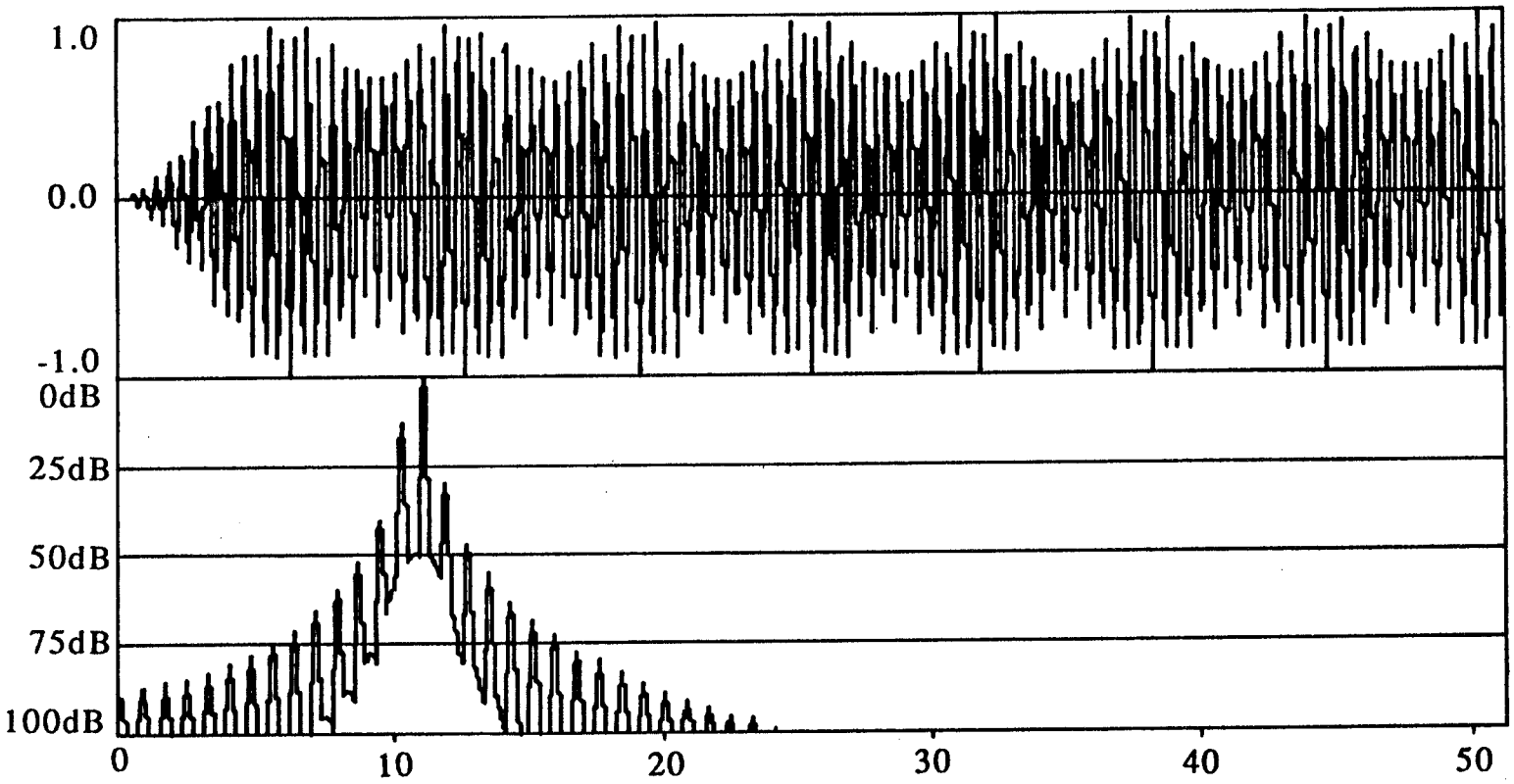
Figure 21:
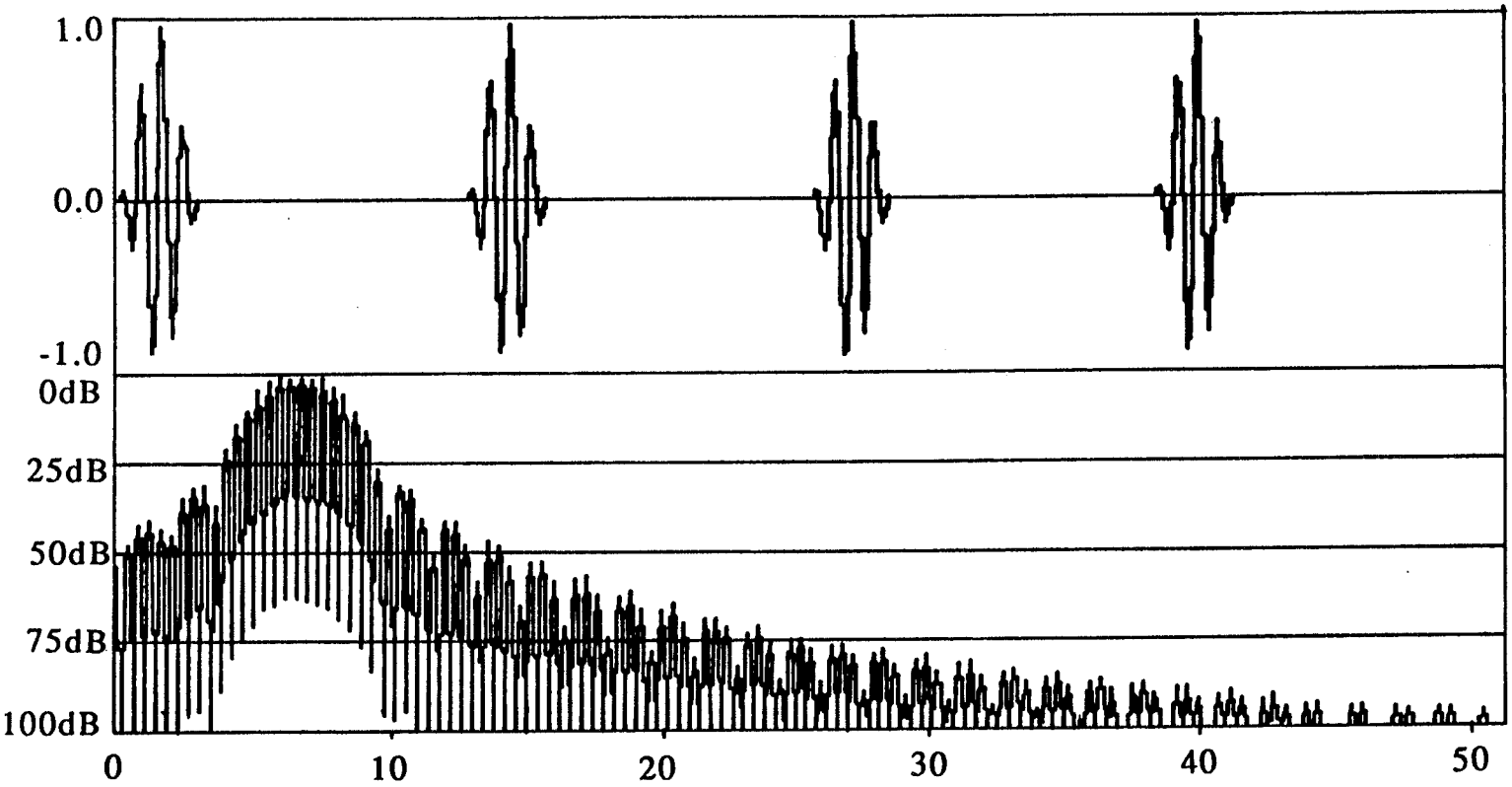
Figure 22:
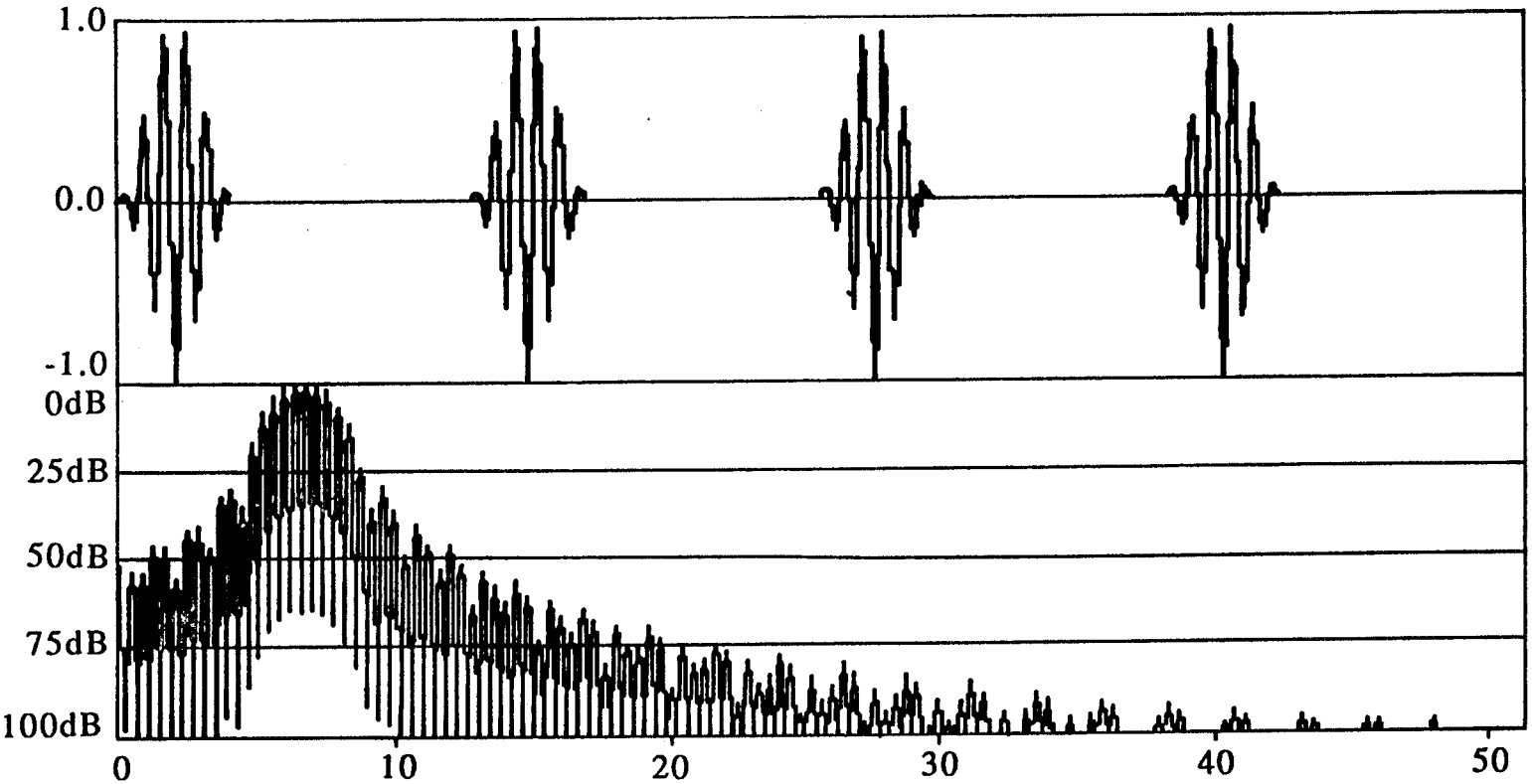
Figure 23:
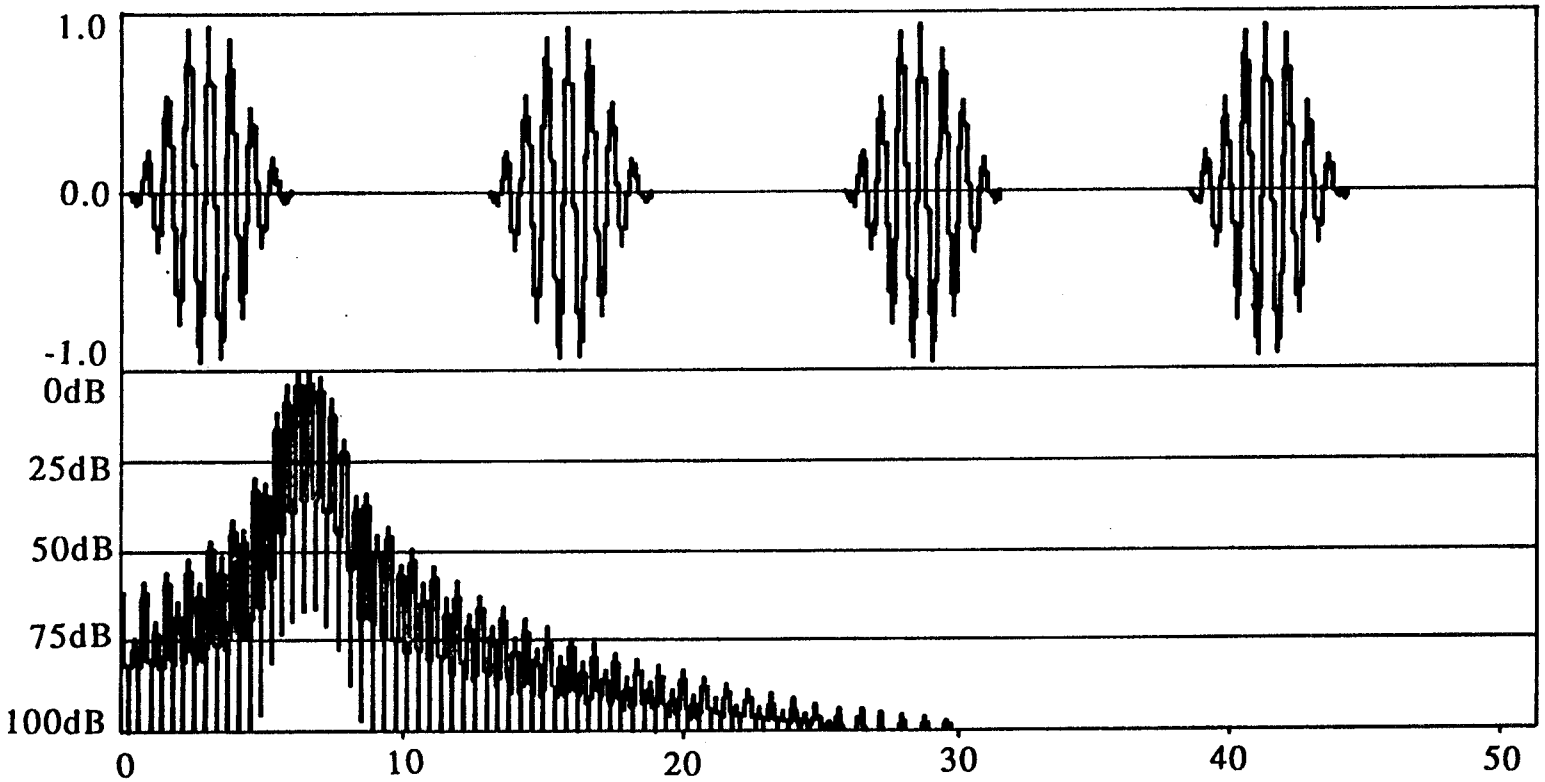
Figure 24:
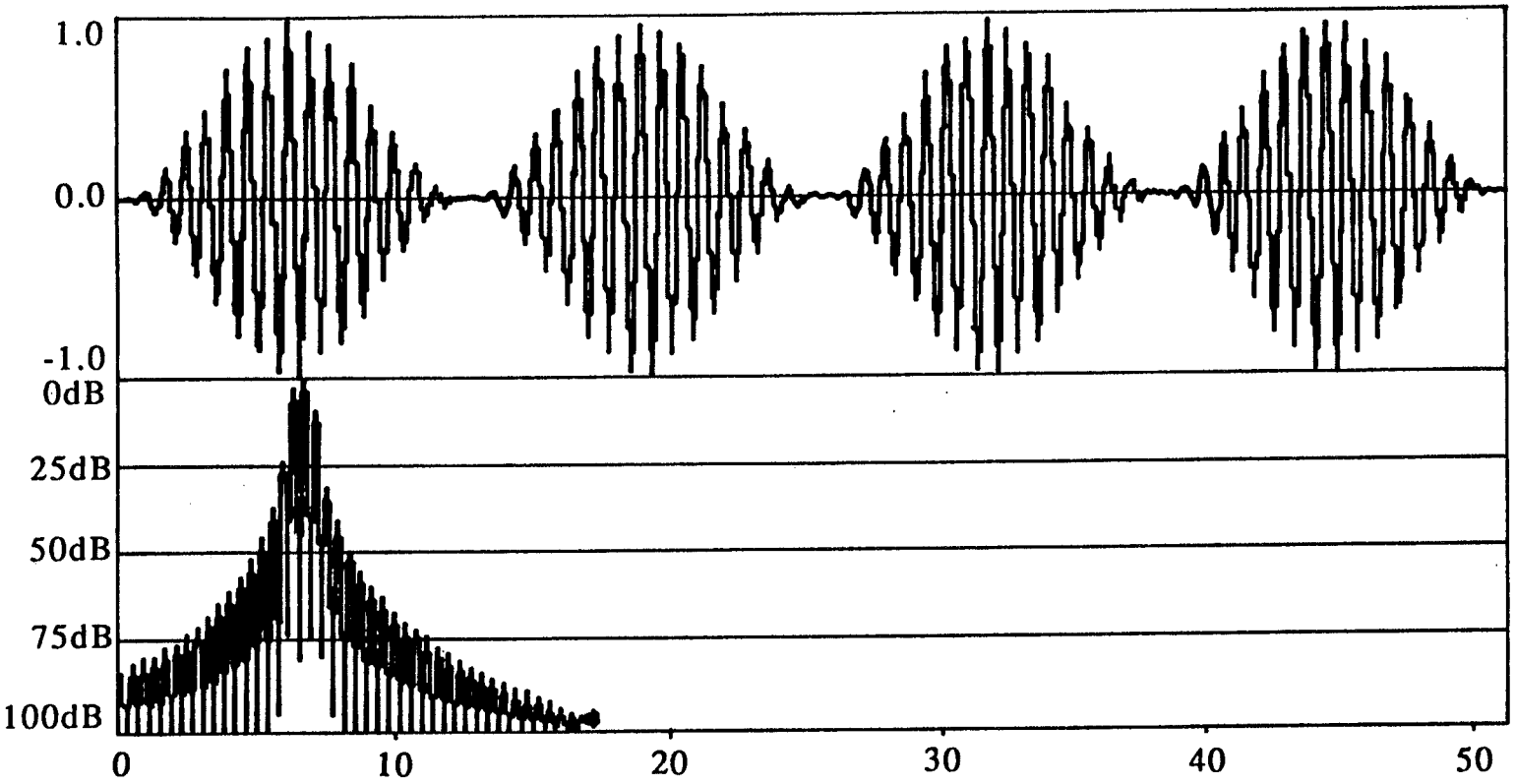
Figure 25:
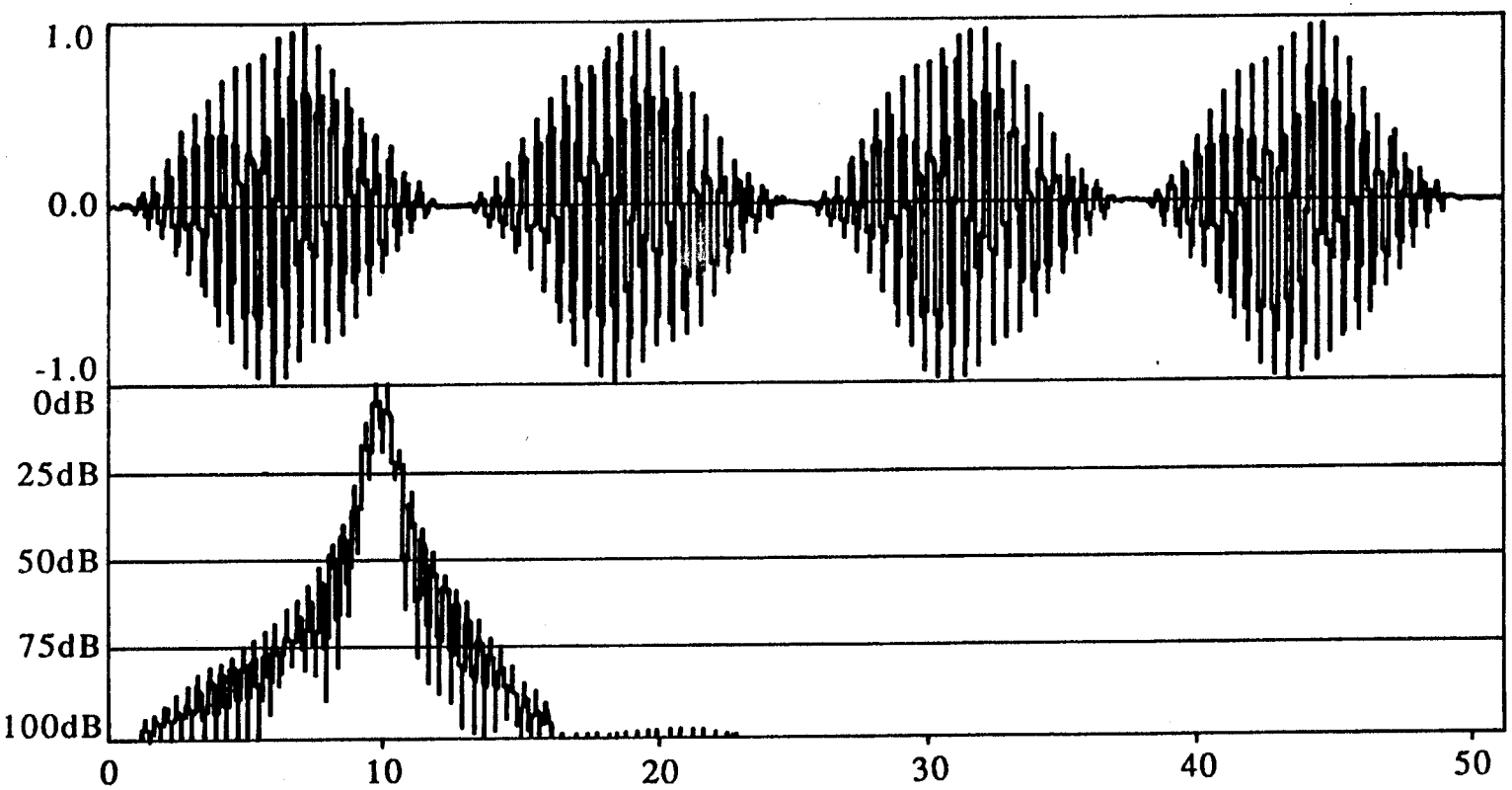
Figure 26:
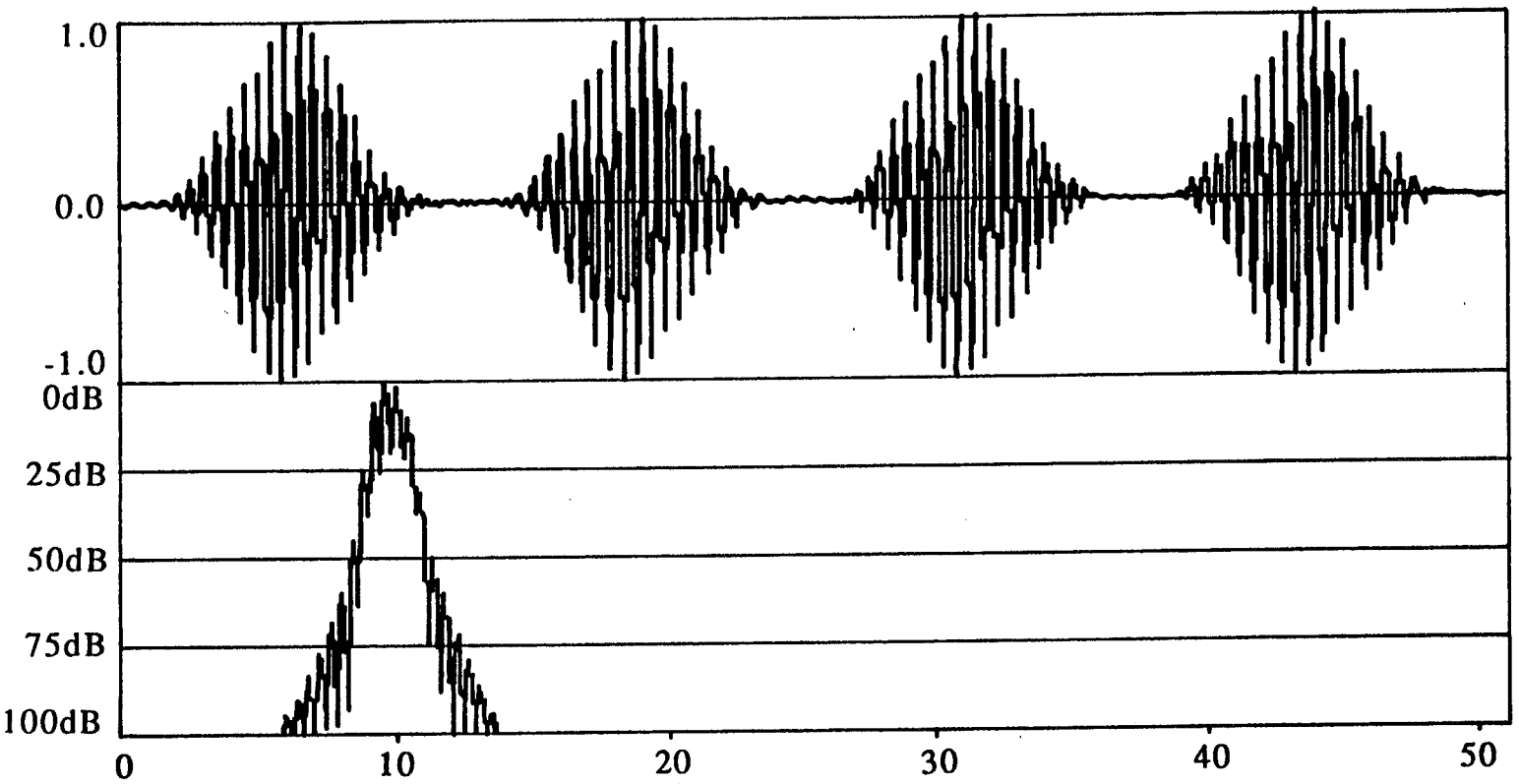
Figure 27:
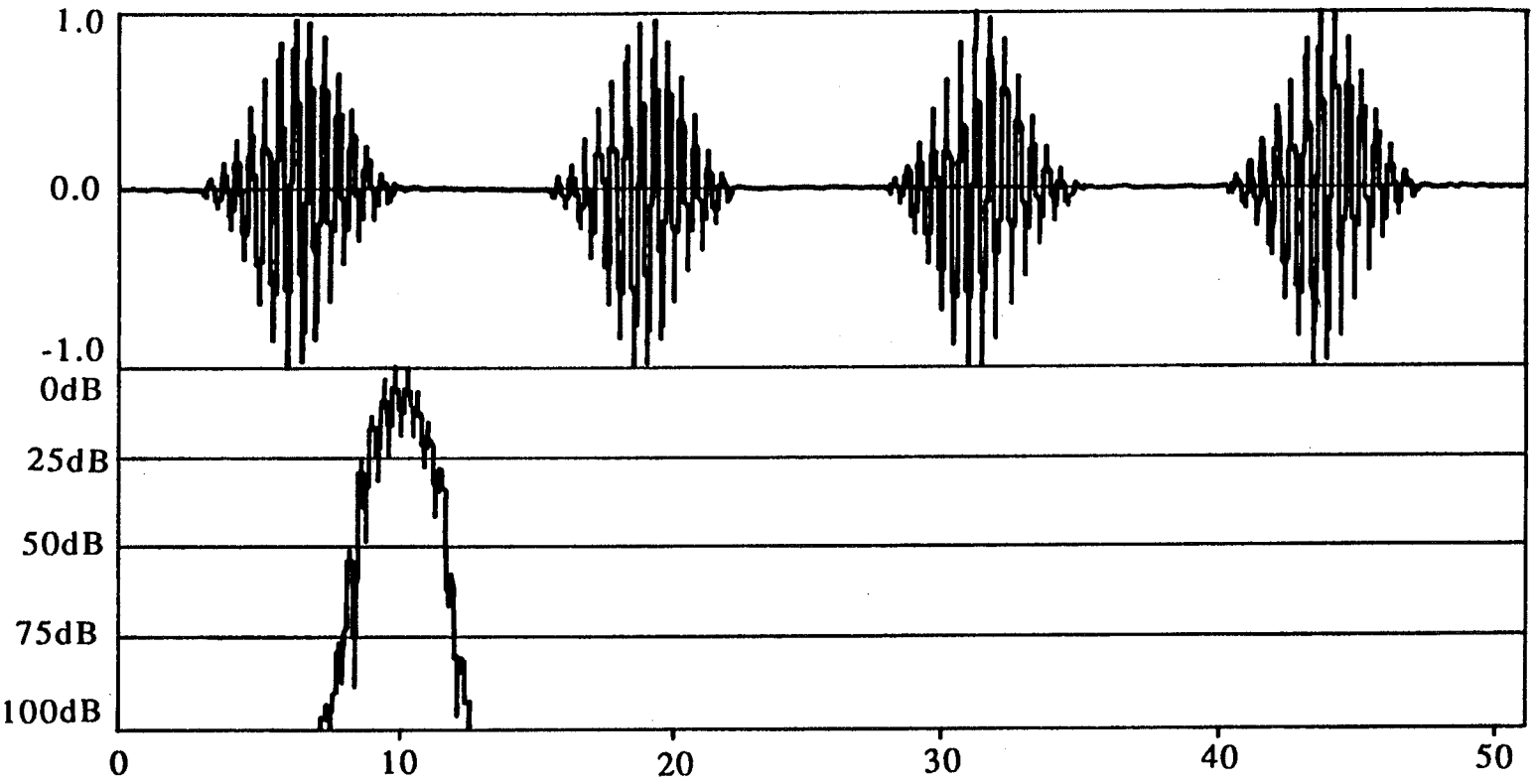
Figure 28:
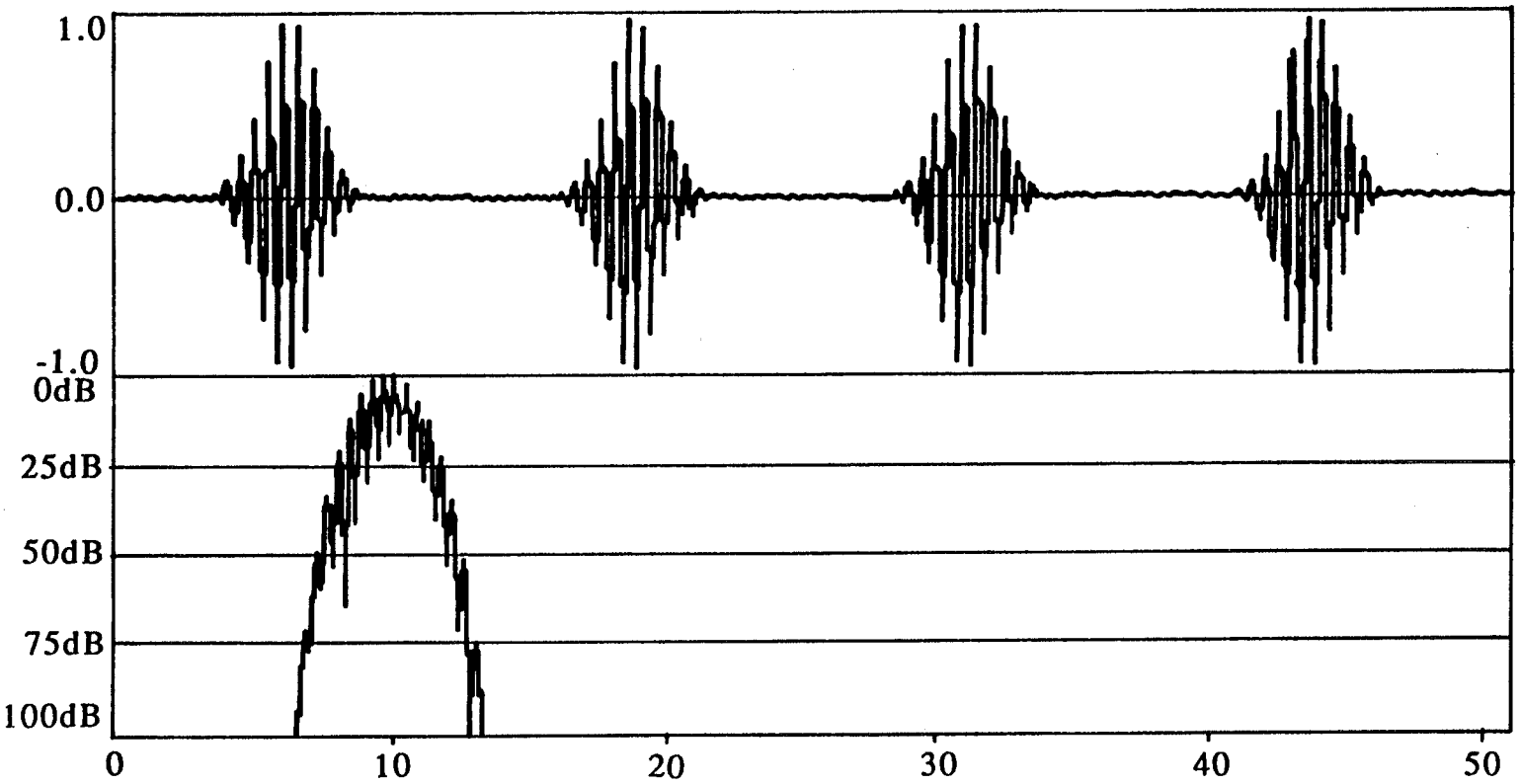

Furthermore, it is possible to divide the window function waveform into first and second sections as shown in FIG. 12. Herein, function of $\sin^{sa}Kat$ is set in the first section, while function of $\sin^{sb}Kbt$ is set in the second section, for example. In order to obtain the waveform continuity in the period of 1/fo, desirable values are set as sa, Ka, sb, Kb. In addition, it is possible to change over these values according to needs, by which the spectrum can be controlled such that its bottom portion will not extended. Therefore, it is possible to vary the tone color of the formant tone without substantially varying the spectrum waveform.

(2) It is possible to generate the formant waveforms based on the accumulation results of the systems #1 to #n by the method other than the foregoing time sharing manner. For example, it is possible to generate the formant waveforms in parallel, wherein it is necessary to modify the circuit configuration of FIG. 4 such that the number of circuits such as numerals 9, 10 etc. is increased.

D. EXPERIMENTS

Next, description will be given with respect to the formant waveforms which are actually produced in some experiments.

In each of FIGS. 13 to 28, upper-side waveform indicates the formant waveform and lower-side waveform indicates the frequency spectrum waveform which has been already subject to Fourier analysis. Herein, the formant center frequency is set at 3350 Hz in all of FIGS. 13 to 16, whereas pitch frequencies of FIGS. 13, 14, 15, 16 are set at 100 Hz, 200 Hz, 400 Hz, 800 Hz respectively. As shown in FIGS. 13 to 16, even if the pitch frequency is deviated, the frequency spectrum is not substantially varied. Particularly, FIG. 16 indicates the case where the fundamental pitch frequency is higher than the window function generating frequency, wherein the frequency spectrum is not substantially changed as a whole as comparing to other frequency spectrums shown in FIGS. 13 to 15.

Similarly, the fundamental pitch frequency is fixed at 400 Hz in all of FIGS. 17 to 20, whereas the formant center frequencies of FIGS. 17, 18, 19, 20 are respectively set at 1250 Hz, 2500 Hz, 3750 Hz, 5500 Hz.

Formant band-widths are gradually narrowed in FIGS. 21, 22, 23, 24. Such control of the formant bandwidth can be carried out by controlling the foregoing phase constant K to be gradually smaller.

FIGS. 25 to 28 indicate the case where the formant waveforms are controlled. Such control of the formant waveform can be carried out by changing over the foregoing shift value data S (see formula (1)). Herein, the value S in FIGS. 25, 26, 27, 28 are set at "1", "2", "3", "4" respectively. Thus, the formant waveform shown in FIG. 25 wherein its peak waveform portion is relatively sharp and its bottom waveform portion is relatively extended is changed to that shown in FIG. 28 wherein its peak waveform portion is not sharp and its bottom waveform portion is relatively narrow.

As described heretofore this invention may be practiced or embodied in still other ways without departing from the spirit or essential character thereof. Therefore, the preferred embodiment described herein is illustrative and not restrictive, the scope of the invention being indicated by the appended claims and all variations which come within the meaning of the claims are intended to be embraced therein.

What is claimed is:

1. A formant tone generating apparatus comprising:

(a) window function generating means for generating n window functions respectively corresponding to n plural systems, where n is an integer, wherein each window function is comprised of a waveform which gradually increases from zero value to a maximum value and then gradually decreases from the maximum value to the zero value;

(b) periodic function generating means for generating periodic functions respectively corresponding to the n systems, each having common a formant center frequency;

(c) modulation means for modulating said periodic function by use of a corresponding window function with respect to each system; and (d) waveform synthesizing means for sequentially synthesizing n waveforms formed and modulated by said modulation means corresponding to the n systems, and combining the n waveforms to produce a synthesized waveform, wherein a formant tone is generated based on the synthesized waveform formed by said waveform synthesizing means without forming unnecessary spectrum.

2. A formant tone generating apparatus comprising:

(a) pitch control means for generating each of pitch control signals of n (where n denotes an integral number) systems at a timing having a period which is n times longer than a fundamental pitch period of a musical tone to be generated, said pitch control means shifting timings of generating said pitch control signals by said fundamental pitch period;

(b) window function generating means for generating a window function having a gradually increasing and decreasing waveform with respect to each system every time each corresponding pitch control signal is generated;

(c) periodic function generating means for generating a periodic function having a common formant center frequency with respect to each system, said periodic function generating means setting a phase of said periodic function at a predetermined phase every time said pitch control signal is generated;

(d) modulation means for modulating said periodic function by use of said window function with respect to each system to thereby generate a modulated signal; and (e) addition means for adding said modulated signal generated from said modulation means with respect to each system;

wherein a formant tone is generated based on an addition result of said addition means.

3. A formant tone generating apparatus according to claim 2 wherein each of said window function generating means, periodic function generating means and modulation means carries out its operation in time sharing manner with respect to each system, whereas said addition means accumulates said modulated signals corresponding to one or more systems at certain tone-generation timing.

4. A formant tone generating apparatus comprising:

(a) pitch control signal generating means for generating each of pitch control signals of n systems (where n denotes an integral number) by a timing of which period is n times longer than a fundamental pitch period of a musical tone to be generated, said pitch control signals being controlled such that timings of generating said pitch control signals are shifted by said fundamental pitch period;

(b) a first accumulator for accumulating a first set value of each system every time each pitch control signal is generated;

(c) a second accumulator for accumulating a second set value of each system which is smaller than said first set value, an accumulation result of said second accumulator being reset to a predetermined value every time corresponding pitch control signal is generated;

(d) a periodic function storing table for storing values of a periodic function, said periodic function storing table being supplied with accumulation results of said first and second accumulators as its address data which is selected in time sharing manner with respect to each system;

(e) power means for raising data read from said periodic function storing table to the k (where k denotes an integral number) power based on the accumulation result of said first accumulator with respect to each system;

(f) multiplication means for multiplying the data read from said periodic function storing table based on the accumulation result of said second accumulator by data outputted from said power means with respect to each system; and (g) accumulation means for accumulating outputs of said multiplication means with respect to one or more systems at certain tone-generation timing.

5. A formant tone generating apparatus according to claim 2 or 4 wherein said number n is determined based on a frequency of said window function and a fundamental pitch frequency which is obtained by inverting said fundamental pitch period.

6. A formant tone generating apparatus according to claim 1, 2 or 4 wherein said periodic function is a sine-wave function.

7. A formant tone generating apparatus comprising:

(a) a waveform provision means for providing a predetermined waveform;

(b) window function generating means for generating a window function based on the waveform provided by the waveform provision means;

(c) periodic function generating means for generating a periodic function, having a formant center frequency, based on the waveform provided by the waveform provision means;

(d) modulation means for modulating said periodic function by use of said window function; and (e) waveform synthesizing means for sequentially synthesizing waveforms formed and modulated by said modulation means.

8. A formant tone generating apparatus according to claim 7 wherein said waveform provision means stores a table representing the predetermined waveform.

9. A formant tone generating apparatus according to claim 7 wherein said window function is obtained through an accumulation operation of a sine waveform.

* * * * *